US005984575A

United States Patent [19]

Knott, Sr.

[11] Patent Number: 5,984,575

[45] Date of Patent: Nov. 16, 1999

[54] FLOOD FLOW MODULATOR

[76] Inventor: James M. Knott, Sr., 456 Hill St., Whitinsville, Mass. 01588

[21] Appl. No.: 09/075,998

[22] Filed: May 11, 1998

[51] Int. Cl.[6] ..... E02B 07/40

[52] U.S. Cl. ..... 405/92; 405/100

[58] Field of Search ..... 405/87, 92, 99, 405/100, 101, 105; 49/10

[56] References Cited

U.S. PATENT DOCUMENTS

| | | | |
|---|---|---|---|
| 820,332 | 5/1906 | Applegate | 405/92 |
| 850,441 | 4/1907 | McGinnis | 405/92 |
| 4,073,147 | 2/1978 | Normura | 405/94 |
| 4,332,507 | 6/1982 | Wakamori et al. | 405/92 |
| 4,549,837 | 10/1985 | Herbert | 405/101 |
| 5,178,490 | 1/1993 | Snowberger et al. | 405/105 |
| 5,758,989 | 6/1998 | Snowberger | 405/80 |

*Primary Examiner*—David Bagnell

*Assistant Examiner*—George M. Mihalik

*Attorney, Agent, or Firm*—John E. Toupal; Harold G. Jarcho

[57] ABSTRACT

A flood flow modulator system including a dam positioned across a watercourse so as to restrict water flow therein and thereby create a retained water body; the dam having an upstream surface facing the water body, an oppositely directed downstream surface, and a top surface joining the upstream and downstream surfaces. Defined by the dam is a slot having substantially vertical side surfaces and a substantially horizontal bottom surface. A gate is pivotally mounted in the slot for movement between a substantially vertical closed position and a substantially horizontal open position; the gate being U-shaped in section and having a front wall with edges disposed adjacent to the side and bottom surfaces so as to substantially close the slot when in the closed position, and sidewalls projecting transversely from the front wall toward the water body and each closely adjacent to a different one of the side surfaces. The sidewalls prevent an accumulation of proximate debris which could adversely affect desired operation of the gate.

20 Claims, 4 Drawing Sheets

FLOOD FLOW MODULATOR

BACKGROUND OF THE INVENTION

This invention relates generally to a water control system and, more particularly, to a system for modulating flood flow in a watercourse.

Dam structures are used extensively to raise the level of a stream or river and thereby produce an elevated head of water which can be used for irrigation or industrial purposes. In some cases, such dam structures include gates that are normally held in an upright closed position but pivot to an open position when the level of a retained water body exceeds a predetermined height. Water gates of this type are operated either manually or by manually initiated electrical or hydraulic actuators controlled by an operator monitoring the level of the water body being retained.

To eliminate the requirement for manual supervision, there have been proposed various types of balanced water gates which open or close automatically in response to the level of the retained water body. Examples of balanced gates are disclosed, for example, in U.S. Pat. Nos. 803,072; 1,039,072 and 4,073,147. Most such automatic gates are designed for operation in response to changes in hydraulic pressure produced by rising and falling levels of the water body. Operational problems of hydraulically operated, balanced gates result from time induced deterioration of bias mechanisms employed for balance control. Also, operation of balanced gates can be adversely effected by accummulated upstream debris or by the downstream deposition of sand, clay and rocks. Also known are gates automatically controlled by float type water level detectors. However, the performance of float operated gates frequently is adversely effected by debris and water currents existing near proximately located float detector devices. Erratic operation of such prior gates can cause significant changes in downstream water flow rates which adversely affect conservation and wildlife interests.

The object of this invention, therefore, is to provide an improved flood flow modulator system.

SUMMARY OF THE INVENTION

The invention is a flood flow modulator system including a dam positioned across a watercourse so as to restrict water flow therein and thereby create a retained water body; the dam having an upstream surface facing the water body, an oppositely directed downstream surface, and a top surface joining the upstream and downstream surfaces. Defined by the dam is a slot having substantially vertical side surfaces and a substantially horizontal bottom surface. A gate is pivotally mounted in the slot for movement between a substantially vertical closed position and a substantially horizontal open position; the gate being U-shaped in section and having a front wall with edges disposed adjacent to the side and bottom surfaces so as to substantially close the slot when in the closed position, and sidewalls projecting transversely from the front wall toward the water body and each closely adjacent to a different one of the side surfaces. The sidewalls prevent an accumulation of proximate debris which could adversely affect desired operation of the gate.

According to one feature of the invention, the gate is mounted for pivotal movement about an axis substantially aligned with a bottom edge of the front wall. Desired gate operation is enhanced by this mounting arrangement.

According to other features of the invention, the system includes an actuator mechanism with a hydraulic cylinder and a piston operatively connected to an upper portion of the front wall and the gate is pivotally mounted to the bottom surface by a plurality of hinge members. These features also enhance desired operation of the gate.

According to another feature, the system includes a seal between each sidewall and the adjacent side surface and each sidewall has a substantially sector shape with radial edges intersecting at a bottom edge of the front wall. The seals and sidewalls prevent leakage through the gate and the sector shape minimizes material requirements for the sidewalls.

According to still other features, the system includes a water level detector disposed to detect the surface level of the water body at a location substantially remote from the gate, and a control for controlling operation of the actuator mechanism to provide movement of the gate toward the open position in response to detection of a water surface level above a given level and to maintain the gate in the closed position in response to detection of a water surface level below the given level. Because of its remote location, operation of the detector is not affected adversely by water currents or accumulated debris.

According to yet other features of the invention, the control establishes intermediate positions of the gate proceeding sequentially from the closed position toward the open position in direct dependence upon detected increasing levels of the water surface level above the given level. These features provide desired control of water level behind the dam.

BRIEF DESCRIPTION OF THE DRAWINGS

These and other objects And features of the invention will become more apparent upon a perusal of the following description taken in conjunction with the accompanying drawings wherein.

DESCRIPTION OF THE PREFERRED EMBODIMENT

Figure 1:
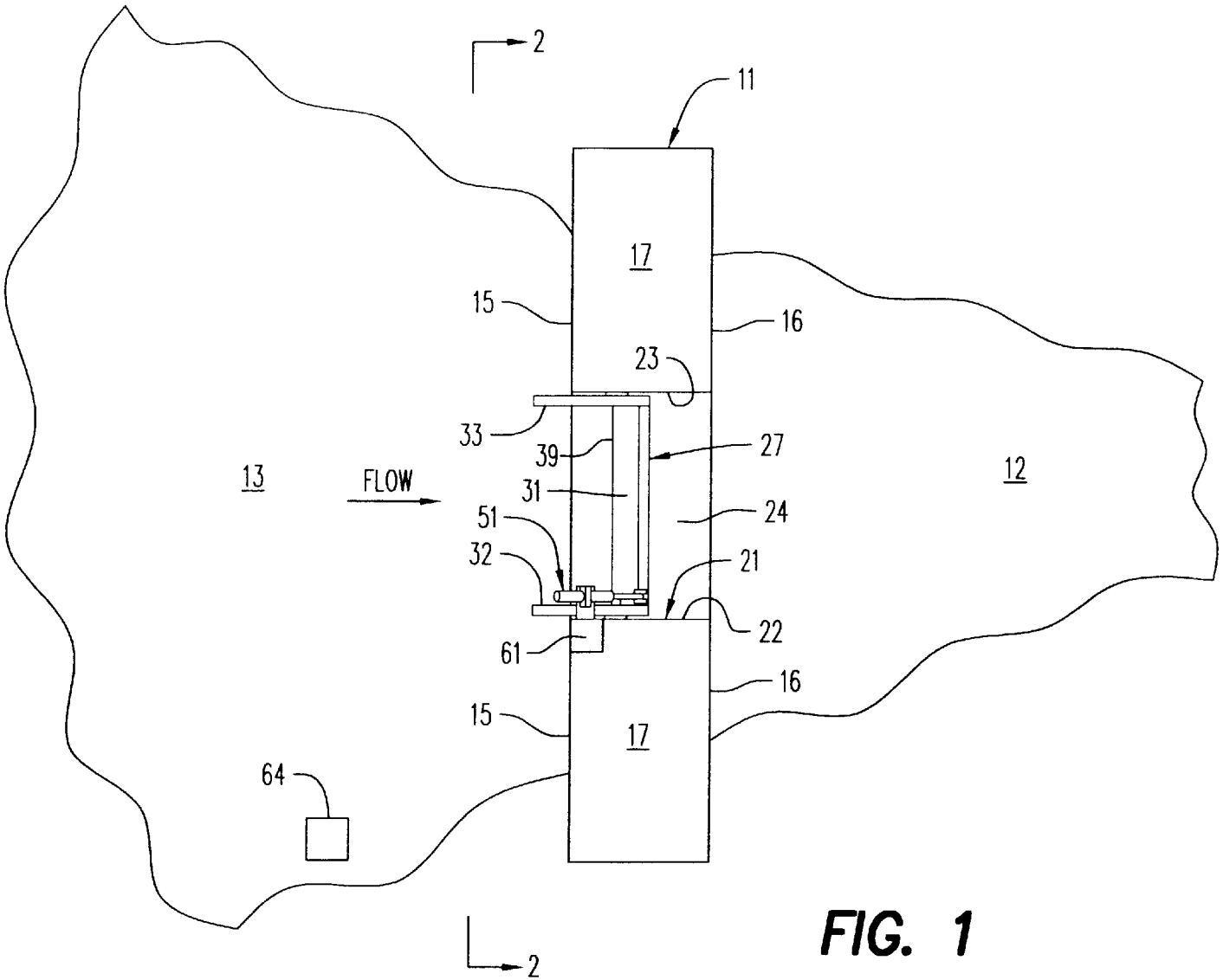
FIG. 1 is a schematic representation of a dam structure disposed across a watercourse in accordance with the invention.

A dam 11 is positioned across a watercourse 12 so as to restrict water flow therein and create a retained water body 13 ad shown in FIG. 1. The dam 11 has an upstream surface 15 facing the water body 13, an oppositely directed downstream surface 16 and a top surface 17 joining the upstream and downstream surfaces 15, 16. Defined by the dam 11 is a slot 21 having vertical side surfaces 22, 23 and a horizontal bottom surface 24. A water control gate 27 is pivotally mounted in the slot 21 for movement between open and closed positions as described hereinafter.

Figure 2:
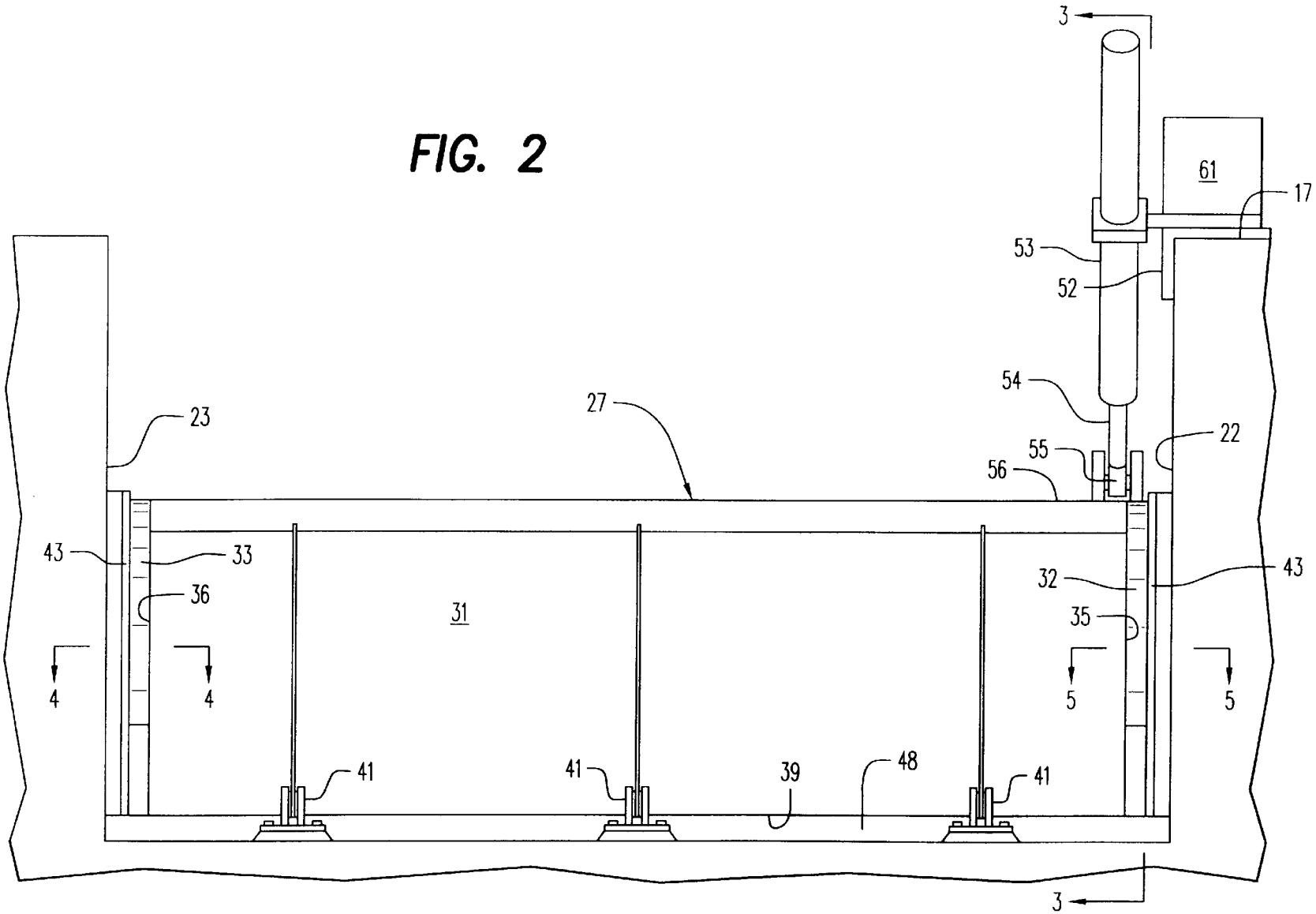
FIG. 2 is an elevational front view taken along lines 2—2 of the dam shown in FIG. 1.
Figure 5:
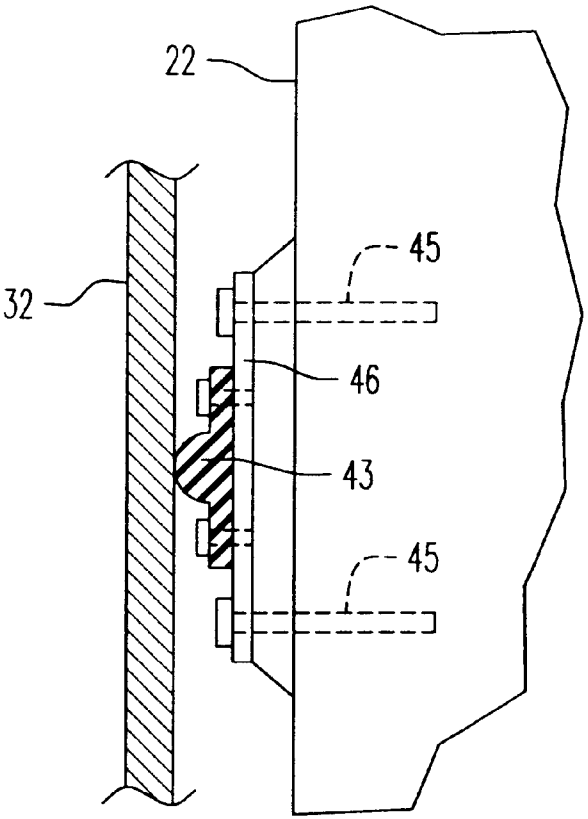
FIG. 5 is a cross-sectional view taken along lines 5—5 of FIG. 2.

The gate 27 (FIGS. 2 and 3) has a U-shaped cross section formed by a front wall 31 and upstream projecting sidewalls 32, 33. As shown in FIG. 2, side edges 35, 36 of the gate 27 extend parallel to and closely adjacent to, respectively, the side surfaces 22, 23 of the slot 21 and a bottom edge 39 of the gate 27 extends parallel and closely adjacent to the bottom surface 24 of the slot 21. The sidewalls 32, 33 extend transversely from, respectively, the side edges 20 35, 36 of the front wall 31. A plurality of longitudinally spaced apart hinge members 41 pivotally mount the gate 27 to the bottom surface 24 of the slot 21. Providing a seal between each of the sidewalls 32, 33 of the gate 27 and, respectively, the side surfaces 22, 23 of the slot 21 are elongated seal members 43 (FIGS. 4 and 5) formed of a suitable resilient material such as neoprene. The seals 43 are secured to the surfaces 22 and 23 by bolts 45 that extend through a mounting plate 46. A similar elongated seal member 48 (FIG. 2) provides a seal between the bottom surface 24 of the slot 21 and the bottom edge 39 of the gate 27.

Figure 3:
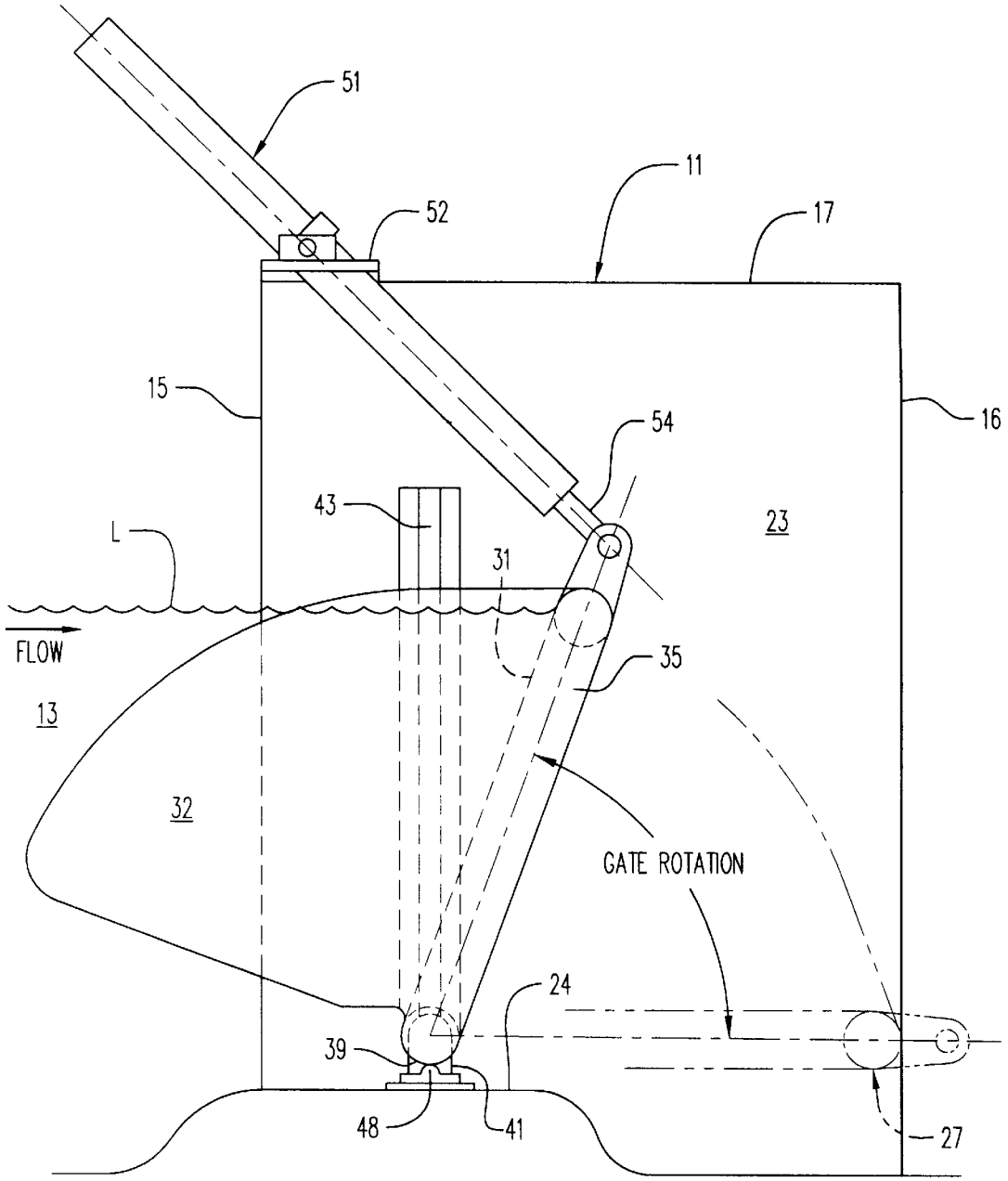
FIG. 3 is a right side elevational view taken along lines 3—3 of a water gate used in the dam shown in FIGS. 1 and 2.
Figure 4:
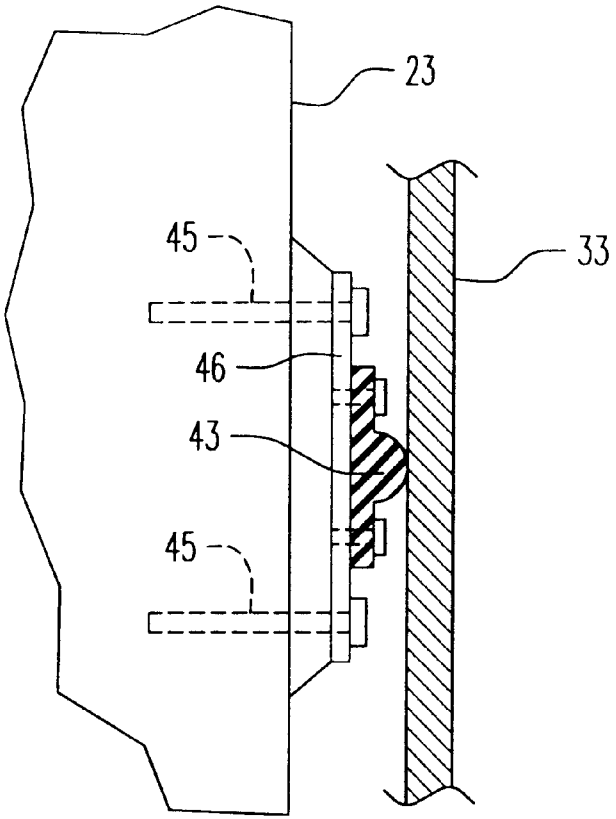
FIG. 4 is a cross sectional view taken along lines 4—4 of FIG. 2.

A hydraulic actuator mechanism 51 is mounted by a bracket assembly 52 to the top surface 17 of the dam 11 and is coupled operatively to the gate 27. Included in the actuator mechanism 51 is a hydraulic cylinder 53 and an associated piston 54 having an end 55 secured to one end of an upper edge 56 of the gate 27. In response to operation of the actuator assembly 51, the gate 27 moves between a substantially vertical closed position to a substantially horizontal open position shown, respectively, by solid and dashed lines in FIG. 3. In its closed position, the gate 27 closes the slot 21 to establish a desired given level L for the water body 13. Conversely, in its open position, the gate 27 allows water flow through the slot 21 so as to reduce the level of the water body 13. With the gate 27 in its closed position, the upstream projecting sidewalls 32, 33 prevent an accumulation of proximate debris which could adversely affect desired operation of the gate. As shown in FIG. 3, the sidewalls 32, 33 have a sector shape with radial edges intersecting at a bottom edge of the front wall. The sector shape minimizes material requirements for the sidewalls 32, 33.

An electrical control system 61 (FIG. 1) is mounted on the dam 11 and controls operation of the actuator mechanism 51. Operatively coupled to the control system 61 is a water level detector 64 positioned at a location substantially remote from the gate 27 so as to be uneffected by water currents associated with operation of the gate 27 and debris accummulated by the dam 11. In response to detection of water levels below a given level L (FIG. 3) the control system 61 maintains the gate 27 in its closed position. Conversely, in response to detection by the detector 64 of water levels above the given level L, the control system 61 responds to move the gate 27 toward its open position and thereby release water through the slot 21. In this way, the desired water level L is maintained and the undesirable effects of significantly different water flow rates downstream of the dam 11 are averted. Preferably, the control system 61 is adapted to provide the gate 27 with intermediate positions between its open and closed positions so as to provide gradual and controlled discharge of water through the slot 27 depending upon the flood conditions detected by the detector 64.

Obviously, many modifications and variations of the present invention are possible in light of the above teachings. It is to be understood, therefore, that the invention can be practiced otherwise than as specifically described.

What is claimed is:

1. A flood flow modulator system comprising:

a dam positioned across a watercourse so as to restrict water flow therein and thereby create a retained water body; said dam having an upstream surface facing said water body, an oppositely directed downstream surface, and a top surface joining said upstream surface and said downstream surface; and said dam defining a slot having substantially vertical side surfaces and a substantially horizontal bottom surface;

a gate pivotally mounted in said slot for movement between a substantially vertical closed position and a substantially horizontal open position; said gate being U-shaped in section and having a front wall with edges disposed adjacent to said side and bottom surfaces so as to substantially close said slot when in said closed position, and sidewalls projecting transversely from said front wall toward said water body and each closely adjacent to a different one of said side surfaces; and an actuator mechanism for moving said gate between said open and closed positions.

2. A flood flow modulator system according to claim 1 wherein said gate is mounted for pivotal movement about an axis substantially aligned with a bottom edge of said front wall.

3. A flood flow modulator system according to claim 2 wherein said actuator mechanism comprises a hydraulic cylinder and a piston operatively connected to an upper portion of said front wall.

4. A flood flow modulator system according to claim 2 wherein said gate is pivotally mounted to said bottom surface.

5. A flood flow modulator system according to claim 4 wherein said gate is pivotally mounted to said bottom surface by a plurality of hinge members.

6. A flood flow modulator system according to claim 2 including seal means providing a seal between each said sidewall and said adjacent side surface.

7. A flood flow modulator system according to claim 6 wherein each said sidewall has a substantially sector shape with radial edges intersecting at said bottom edge of said front wall.

8. A flood flow modulator system according to claim 7 wherein said actuator mechanism comprises a hydraulic cylinder and a piston operatively connected to an upper portion of said front wall.

9. A flood flow modulator system according to claim 8 wherein said gate is pivotally mounted to said bottom surface.

10. A flood flow modulator system according to claim 9 wherein said gate is pivotally mounted to said bottom surface by a plurality of hinge members.

11. A flood flow modulator system according to claim 1 including a water level detector disposed to detect the surface level of said water body at a location substantially remote from said gate, and a control means for controlling operation of said actuator mechanism to provide movement of said gate toward said open position in response to detection by said detector of a said surface level above a given level and to maintain said gate in said closed position in response to detection by said detector of a said surface level below said given level.

12. A flood flow modulator system according to claim 11 wherein said control means is adapted to establish intermediate positions of said gate between said open and closed positions, said intermediate positions proceeding sequentially from said closed position toward said open position in direct dependence upon detected increasing levels of said surface level above said given level.

13. A flood flow modulator system according to claim 11 wherein said gate is mounted for pivotal movement about an axis substantially aligned with a bottom edge of said front wall.

14. A flood flow modulator system according to claim 13 wherein said actuator mechanism comprises a hydraulic cylinder and a piston operatively connected to an upper portion of said front wall.

15. A flood flow modulator system according to claim 13 wherein said gate is pivotally mounted to said bottom surface.

16. A flood flow modulator system according to claim 15 wherein said gate is pivotally mounted to said bottom surface by a plurality of hinge members.

17. A flood flow modulator system according to claim 13 including seal means providing a seal between each said sidewall and said adjacent side surface.

18. A flood flow modulator system according to claim 17 wherein each said sidewall has a substantially sector shape with radial edges intersecting at said bottom edge of said front wall.

19. A flood flow modulator system according to claim 18 wherein said actuator mechanism comprises a hydraulic cylinder and a piston operatively connected to an upper portion of said front wall.

20. A flood flow modulator system according to claim 19 wherein said gate is pivotally mounted to said bottom surface.

* * * * *

UNITED STATES PATENT AND TRADEMARK OFFICE

CERTIFICATE OF CORRECTION

PATENT NO. : 5,984,575
DATED : November 16, 1999
INVENTOR(S) : James M. Knott, Sr.

It is certified that error appears in the above-identified patent and that said Letters Patent is hereby corrected as shown below:

Column 2, line 33, "And" should read --and--.

Column 2, line 55, "ad" should read --as--.

Signed and Sealed this

Ninth Day of May, 2000

*Attest:*

Q. TODD DICKINSON

*Attesting Officer*

*Director of Patents and Trademarks*